US007250834B2

(12) United States Patent
Saitou et al.

(10) Patent No.: US 7,250,834 B2
(45) Date of Patent: Jul. 31, 2007

(54) BANDPASS FILTER FOR DIFFERENTIAL SIGNAL, AND MULTIFREQUENCY ANTENNA PROVIDED WITH SAME

(75) Inventors: Akira Saitou, Machida (JP); Kazuhiko Honjo, Chofu (JP)

(73) Assignees: YKC Corporation, Musashimurayama-shi (JP); Campus Create Co., Ltd., Setagaya-ku (JP)

( * ) Notice: Subject to any disclaimer, the term of this patent is extended or adjusted under 35 U.S.C. 154(b) by 0 days.

(21) Appl. No.: 11/674,499

(22) Filed: Feb. 13, 2007

(65) Prior Publication Data

US 2007/0126533 A1 Jun. 7, 2007

Related U.S. Application Data

(62) Division of application No. 11/045,169, filed on Jan. 27, 2005, now Pat. No. 7,196,597.

(30) Foreign Application Priority Data

Jan. 28, 2004 (JP) ..... 2004-019687

(51) Int. Cl.
*H01P 1/203* (2006.01)

(52) U.S. Cl. ..... 333/204; 333/4

(58) Field of Classification Search ..... 333/4, 333/5, 204, 205, 219, 116, 117
See application file for complete search history.

(56) References Cited

U.S. PATENT DOCUMENTS 7,102,455 B2 * 9/2006 Lin et al. ..... 333/1

* cited by examiner

*Primary Examiner*—Stephen E. Jones
(74) *Attorney, Agent, or Firm*—Christensen O'Connor Johnson Kindness PLLC

(57) ABSTRACT

There is provided a bandpass filter for a differential signal applicable to a device having a wide passband, being a device for transmitting a signal using a differential signal. Respective lines 1 and 2 and lines 3 and 4 are provide on two surfaces P1 and P2 at an inner layer of a dielectric body 9. Each two lines are arranged symmetrically about the same plane of symmetry C, and the length of each line is a quarter wavelength at the center frequency of a used band. Reference numerals 5 and 6 are input/output ends of the lines 1 and 2, and 7 and 8 are input output ends of lines 3 and 4. Opposite ends to the input output ends are open. If a differential signal is input to terminals 5, 6, a differential output appears at the terminals 7, 8. This device works as a bandpass filter.

4 Claims, 9 Drawing Sheets

(a)

(b)

(a) Example characteristics for wide band bandpass filter (b) Example characteristics for narrow band bandpass filter Example characteristics for band bandpass filter having band stop filter

BANDPASS FILTER FOR DIFFERENTIAL SIGNAL, AND MULTIFREQUENCY ANTENNA PROVIDED WITH SAME

CROSS-REFERENCE TO RELATED APPLICATION

This application is a divisional of prior application Ser. No. 11/045,169, filed Jan. 27, 2005 now U.S. Pat. No. 7,196,597, priority from the filing date of which is hereby claimed under 35 U.S.C. § 120.

FIELD OF THE INVENTION

This invention relates to a bandpass filter for a differential signal that can be applied to an ultra wideband wireless system capable of high speed transmission, and to a multifrequency antenna provided with a plurality of such bandpass filters.

BACKGROUND OF THE INVENTION

Description of the Related Art

In recent years, close range wireless interfaces such as wireless LANs and Bluetooth (trademark) have become widely used, but ultrawideband wireless systems (UWB) have been receiving even greater attention as the next generation of systems to enable even higher speed transmission. Specification investigations are currently progressing in various countries, but it is recognized that the usage frequency for these UWB systems in the US is 3.1-10.6 GHz with a comparatively large output. This UWB system is capable of high-speed wireless transmission at 100 Mbps or above due to use of frequencies in an extremely wide band.

An antenna using the above-described UWB system transmits extremely wideband signals, but the antenna is capable of receiving radio waves in a wider range than the UWB frequency band. For this reason, noise outside the band is also received, there is a problem of the effective noise becoming large. In order to resolve this problem, there has been a demand for a filter suitable for an ultrawideband antenna.

The present invention applies to a bandpass filter for a differential signal suitable for an ultra wideband antenna, and to a multifrequency antenna provided with a plurality of such bandpass filters.

SUMMARY OF THE INVENTION

A bandpass filter for a differential signal of the present invention is provided with a dielectric body, a first line and a second line on a surface of the dielectric body or a first surface of an inner part of the dielectric body arranged symmetrically to each other with respect to a surface of symmetry crossing the first surface, and a third line and a fourth line on another surface of the dielectric body or a second surface, which is another surface of an inner part of the dielectric body and faces the first surface, arranged symmetrically to each other with respect to the surface of symmetry, wherein the first to fourth lines have respective line lengths equivalent to a quarter wavelength of a center frequency of a used band, one end of each of the first to fourth lines is an input/output end with the other ends being an open end, and input/output ends of the first line and second line are arranged close to the open ends of the third line and the fourth line.

The line length equivalent to a quarter wavelength means not only 0.25 wavelengths, but also 0.75 wavelengths, 1.25 wavelengths, 1.75 wavelengths, etc. This also applies in the following.

It is also possible for a line having a line length equivalent to a quarter wavelength of a frequency to be stopped and with one end open to be connected to the first line or the third line, and for a line having a line length equivalent to a quarter wavelength of a frequency to be stopped and with one end open to be connected to the second line or the fourth line.

A bandpass filter for a differential signal of the present invention is provided with a dielectric body, a first line and a second line on a surface of the dielectric body or a first surface of an inner part of the dielectric body arranged symmetrically to each other with respect to an surface of symmetry crossing the first surface, a third line, and a fourth line on another surface of the dielectric body or a second surface, which is another surface of an inner part of the dielectric body and faces the first surface, arranged symmetrically to each other with respect to the surface of symmetry, and a fifth line and a sixth line arranged symmetrically to each other with respect to the surface of symmetry on the first surface, wherein the first line, the second line, the fifth line, and the sixth line respectively have a line length equivalent to a quarter wavelength of a center frequency of a used band, the third line and the fourth respectively have line lengths equivalent to a half wavelength of a center frequency of a used band, the first line, the second line, the fifth line, and the sixth line respectively have one end as an input/output end, and the other end as an open end, both ends of each of the third line and the fourth line are open ends, the first line and the fifth line are arranged in a cascade manner with their open ends adjacent, and both are facing the third line, and the second line and the sixth line are arranged in a cascaded manner with their open ends adjacent, and both are facing the fourth line.

It is also possible for a line having a line length equivalent to a quarter wavelength of a frequency to be stopped and with one end open to be connected to the third line close to or at a connection point between open ends of the first line and the fifth line, and for a line having a line length equivalent to a quarter wavelength of a frequency to be stopped and with one end open to be connected to the fourth line close to or at a connection point between open ends of the second line and the sixth line. Here, the word "close" includes a meaning of "at."

It is further possible for low-pass filters for stopping a signal that is a higher than a predetermined frequency to be respectively provided at input/output ends of the first line and the second line. It is also possible for the low-pass filters to be respectively provided at input/output ends of the fifth line and the sixth line. These two situations are effectively the same.

A multifrequency antenna, of the present invention, comprises a wideband antenna driven by a differential signal, and a first bandpass filter and a second bandpass filter connected in parallel to a feed point of the wideband antenna. The first bandpass filter and/or the second bandpass filter are any of the bandpass filter for a differential signal described above.

According to the present invention, it is possible to provide a bandpass filter for a differential signal applicable to a device having a wide passband, being a device for transmitting a signal using a differential signal such as a self complementary antenna. The bandpass filter for a differential signal of the present invention is small and inexpensive.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 1(*a*) is a plan view of the filter, while FIG. 1(*b*) is a cross section along arrows A-A.

DETAILED DESCRIPTION OF THE PREFERRED EMBODIMENT

First Embodiment

A bandpass filter for a differential signal relating to the first embodiment of the invention will now be described with reference to the drawings. First of all, the structure of this bandpass filter for a differential signal will be described, and then theoretical operation of this bandpass filter for a differential signal and its characteristics will be described.

Figure 1:
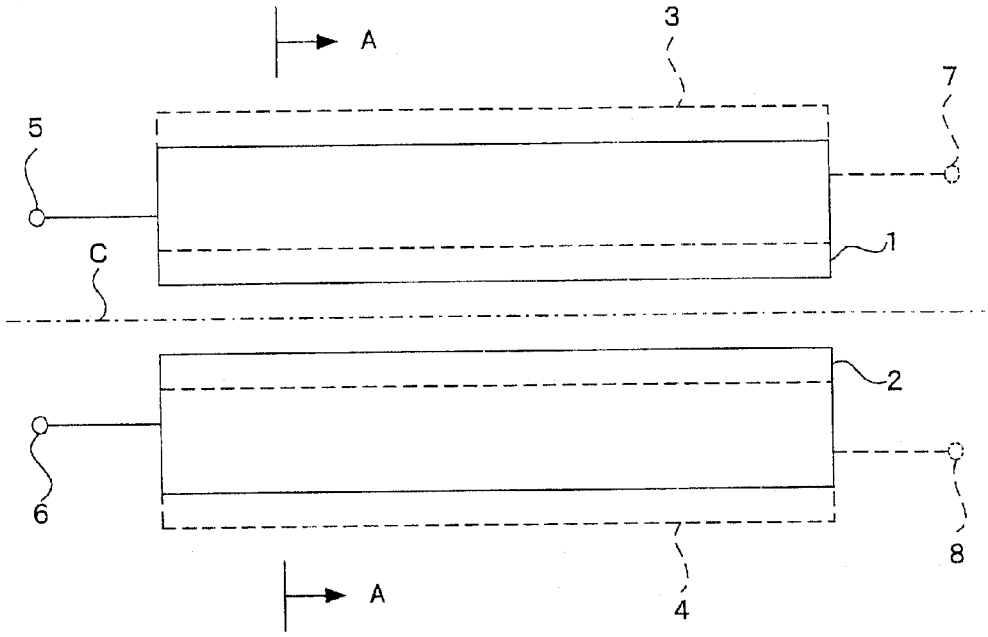
FIG. 1 is a structural drawing of the filter relating to the first embodiment of the invention.
Figure 1:
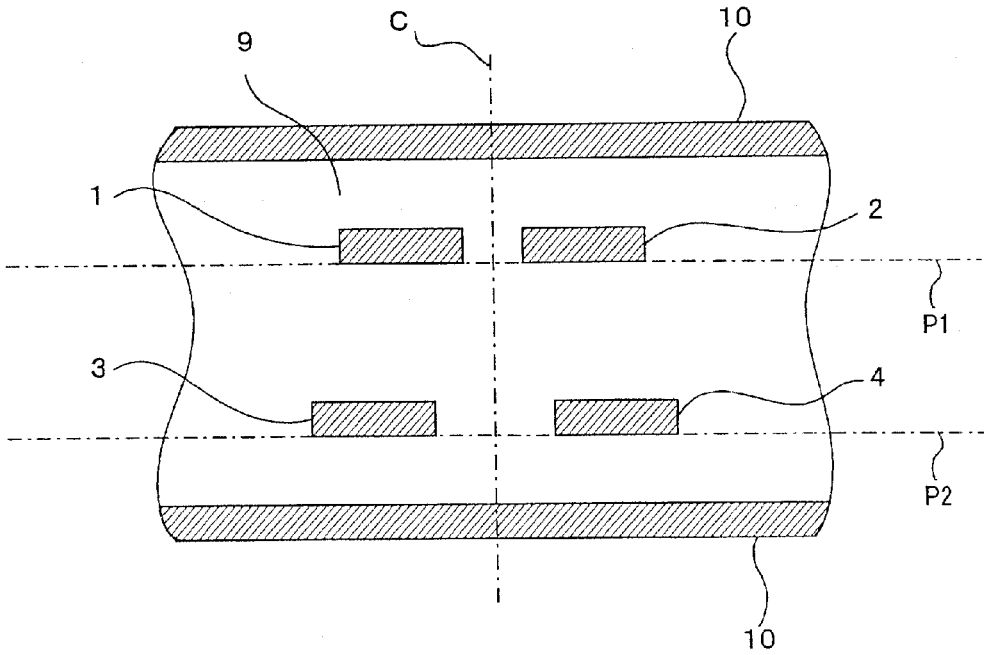

The structure of the filter relating to the first embodiment of the invention is shown in FIG. 1(*a*) and FIG. 1(*b*). FIG. 1(*a*) is a plan view of the filter, while FIG. 1(*b*) is a cross sections looking in the direction of arrows A-A in the plan view (arrow A-A cross sectional view). In these drawings, reference numeral 1 is a first line, 2 is a second line, 3 is a third line, and 4 is a fourth line. Reference numeral 5 is an input/output end of the first line 1, while 6 is an input/output end of the second line 2. The input/output ends 5, 6 together form a first differential input/output end. Ends at the opposite side to the input/output ends 5, 6 of the first line 1 and the second line 1 are electrically open. Reference numeral 7 is an input/output end of the third line 3, and 8 is an input/output end of the fourth line 4. The input/output ends 7, 8 together form a second differential input/output end. Ends at the opposite side to the input/output ends 7, 8 of the third line 3 and the fourth line 4 are electrically open. Reference numeral 9 is a dielectric body, and 10 is a ground electrode provided on both surfaces of the dielectric body 9.

C is a surface of symmetry passing vertically through the dielectric body 9. P1 is a first surface inside the dielectric body 9, and P2 is a second surface below the first surface P1. The first surface P1 and the second surface P2 are substantially parallel to each other, with these surfaces P1 and P2 being substantially parallel to the surface of the dielectric body 9 and the ground electrode 10. The surface of symmetry C, first surface P1, and second surface P2 are shown so as to simplify understanding, and actually these surfaces do not exist. When the filter of FIG. 1 is made using a laminated dielectric substrate, it is also possible for the first surface P1 and the second surface P2 to exist as a surface of the dielectric substrate.

FIG. 1(*a*) shows the third line 3, fourth line 4, and input/output end 7 as dotted lines, but this indicates that they are respectively positioned below the first surface P1 where the first line 1 and second line 2 are provided. With respect to the relationship of FIG. 1(*b*), since the dielectric body 9 and the ground electrode 10 exist at an upper side of the first line 1, second line 2 and input output ends 5, 6, these should also be shown as dotted lines, but in order to make the drawing easier to comprehend, they are shown as solid lines.

The first line 1 and second line 2 are arranged on the first surface P1 (it is also possible to be on one surface of the dielectric body 9) inside the dielectric body 9, symmetrical to each other about the surface of symmetry C. The third line 3 and fourth line 4 are arranged on the second surface P2 (it is also possible to be on the other surface of the dielectric body 9) inside the dielectric body 9, symmetrical to each other about the surface of symmetry C. The first line 1 to fourth line 4 have respective line lengths equivalent to a quarter wavelength of a center frequency of a used band. That is, the line length is 0.25 wavelengths, 0.75 wavelengths, 1.25 wavelengths, 1.75 wavelengths, etc. The characteristics of the filter relating to the embodiment of the invention are repeated every half wavelength, as described above. This also applies in the following description. That is, at half wavelength steps, S11, which will be described later, becomes the same phase at the same amplitude (S11) while S21, which will be described later, becomes 180° out of phase at the same amplitude (−S21). S21 operates in the same way, even if phase is reversed, provided that the passing amount (twice the absolute value of S21) is the same. One end of each of the first line 1 to fourth line 4 is made an input/output end 5 to 8, with the respective other ends being open ends. Input/output ends 5, 6 of the first line 1 and second line 2 are arranged close to the open ends of the third line 3 and the fourth line 4 (positioned to the left side in FIG. 1(*a*)). Input/output ends 7, 8 of the third line 3 and fourth line 4 are adjacent to the open ends of the first line 1 and the second line 2 (positioned to the right side in FIG. 1(*b*)). Therefore, signals input to the input output ends 5, 6 on the left side in FIG. 1(*a*) pass through the first line 1 and the second line 2, and the third line 3 and the fourth line 4, and are output to the input output ends 7, 8 at the right side. If signals are input to the input/output ends 5, 6, outputs appear at the input/output ends 7, 8.

A differential signal is input to first differential input/output ends 5, 6 of this bandpass filter for a differential signal shown in FIG. 1, or to second differential input/output ends 7, 8, and it is possible to extract a band limited differential signal from the other differential input/output end using this bandpass filter.

Figure 2:
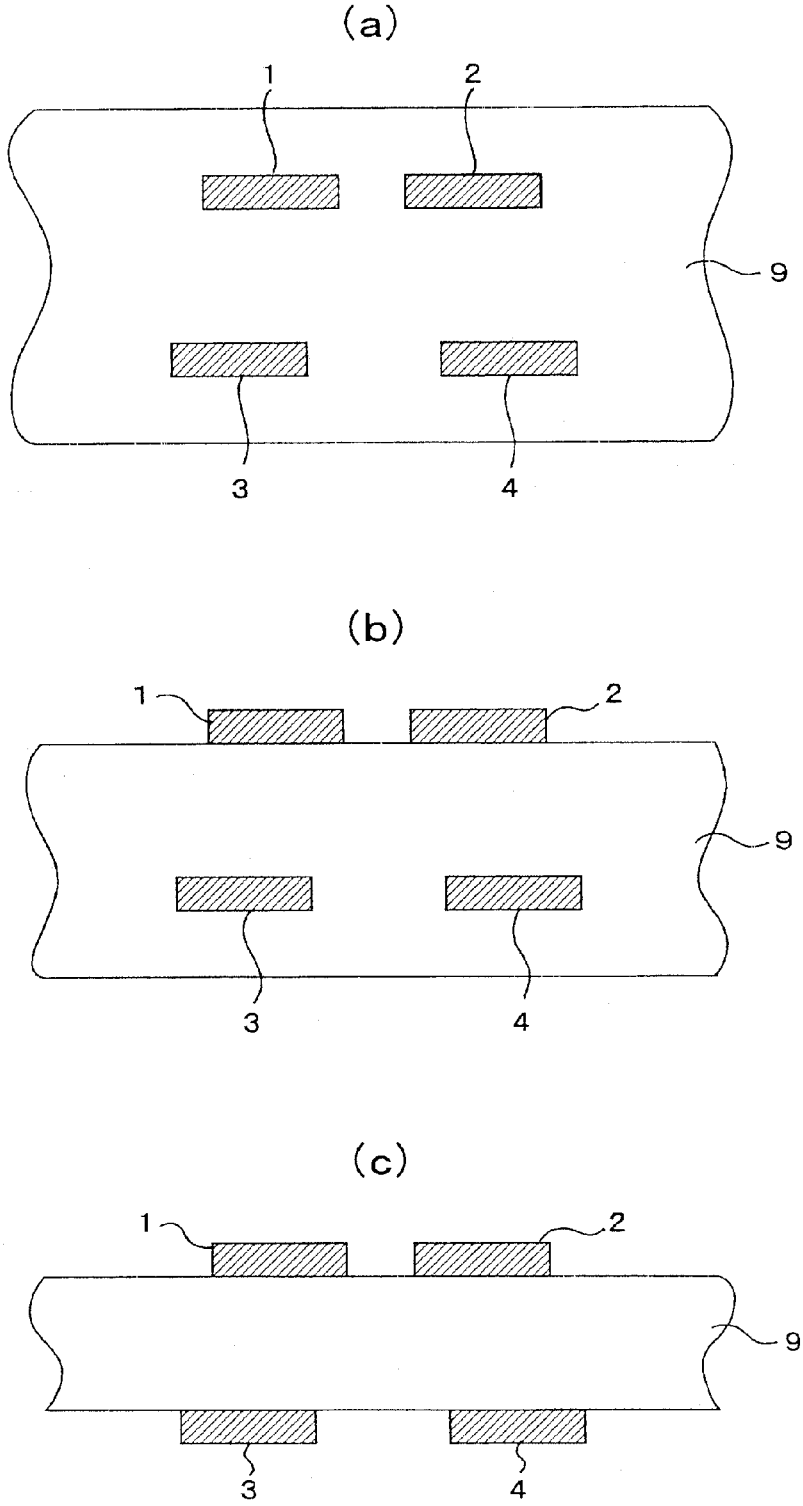
FIG. 2 is another example of a cross section of the filter relating to the first embodiment of the invention.

This bandpass filter for a differential signal is realized by a four-line connection circuit constituted by two lines each 1 to 4 that are symmetrical about the surface of symmetry C and arranged on the first surface P1 and the second surface P2. This four line connection circuit, as shown in FIG. 1(*b*), can have a ground electrode 10 on both sides, or may not have the ground electrode, as shown in FIG. 2(*a*), and may have the first line 1 to fourth line 4 embedded inside the dielectric body 9. Alternatively, as shown in FIG. 2(*c*), it is possible to have the first line 1 to fourth line 4 on both surfaces of the dielectric body 9 (in this case, the first surface P1 and the second surface P2 are the front surface and rear surface of the dielectric body 9), or, as shown in FIG. 2(*b*), it is possible to have some lines embedded and the others on the surface.

According to the bandpass filter for a differential signal of the first embodiment of the present invention, it is possible to realize a bandpass filter for a differential signal, and also a circuit having an impedance conversion function. Also, as the structure is only lines, there are the advantages of small size, ease of mass production, and low cost.

Theoretical operation and characteristics of this bandpass filter for a differential signal will now be described.

Figure 3:
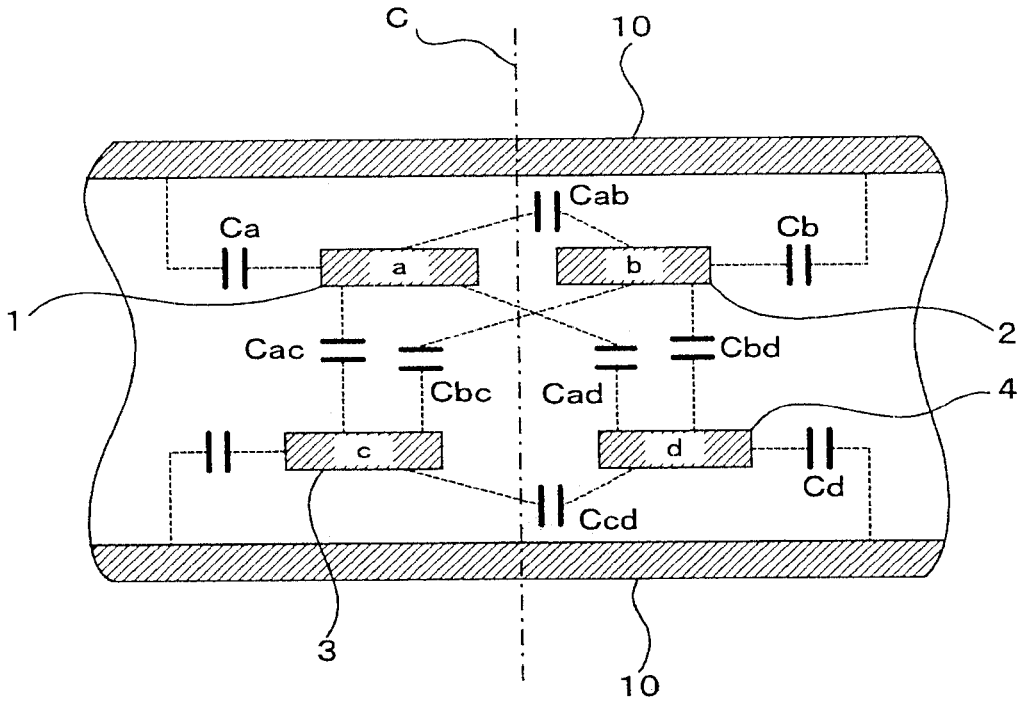
FIG. 3 is an explanatory drawing for capacitance between each electrode of the filter relating to the first embodiment of the invention.

In FIG. 3, reference characters a, b, c, and d respectively represent the first line 1, the second line 2, the third line 3, and the fourth line 4. By defining the lines in this way, it is possible to represent capacitance between electrodes of the 4 line connection line as Cx, Cxy, etc. (where x, y=a, b, c, d). Here, Cx represents capacitance between electrode x and ground, while Cxy represents capacitance between electrodes x and y. These capacitances are shown in FIG. 3.

Operation of the 4 line connected circuit of the first embodiment of the invention will be described in the following. A C matrix as described below is defined using the capacitances between electrodes defined in FIG. 3.

$$C=\begin{pmatrix} Ca+Cab+Cac+Cad, & -Cab, & -Cac, & -Cad \\ -Cab, & Cb+Cab+Cad+Cac, & -Cbc, & -Cbd \\ -Cac, & -Cbc, & Cc+Cac+Cbc+Ccd, & -Ccd \\ -Cad, & -Cbd, & -Ccd, & Cd+Cad+Cbd+Ccd \end{pmatrix} \quad \text{Equation 1.}$$

Here, due to symmetry, Ca=Cb, Cc=Cd, Cac=Cbd, and Cad=Cbc.

The number of unknown terms can therefore be reduced by four, from ten terms to the six terms, Ca, Cc, Cab, Cac, Cad, and Ccd.

$$C=\begin{pmatrix} Ca+Cab+Cac+Cad, & -Cab, & -Cac, & -Cad \\ -Cab, & Ca+Cab+Cad+Cac, & -Cad, & -Cac \\ -Cac, & -Cad, & Cc+Cac+Cad+Ccd, & -Ccd \\ -Cad, & -Cac, & -Ccd, & Cc+Cad+Cac+Ccd \end{pmatrix} \quad \text{Equation 2.}$$

A Y matrix for this line is therefore given as follows for within an isotropic medium. What is considered here includes lecher lines and microstrips on the dielectric substrate so that there are differences in speed according to the mode. Therefore, this generally speaking is not a perfect solution but does establish an approximation. Loss at this time is made small, and if a zero loss line is considered, the Y matrix is obtained as shown below.

$$Y=1/jk_z\begin{pmatrix} j\omega Ccoth(jk_zZ) & -j\omega Ccsch(jk_zZ) \\ -j\omega Ccsch(jk_zZ) & j\omega Ccoth(jk_zZ) \end{pmatrix}= jvp\begin{pmatrix} -Ccot(k_zZ), & Ccsc(k_zZ) \\ Ccosec(k_zZ), & -Ccot(k_zZ) \end{pmatrix} \quad \text{Equation 3.}$$

vp represents phase velocity. The y matrix is an 8×8 square matrix.

Here, by adding the conditions of the right ends of the lines 1 and 2 are open, the left ends of the lines 3 and 4 are also open, and the following conditions for odd mode, a 4 terminal matrix for between 4 terminated terminals is obtained.

Although there are 4 terminals, due to the fact that odd mode is provided, two terminals have current and voltage in opposite phases to the other two terminals, and so can be omitted, and as a result, the four terminals can be represented using a current voltage relationship for between the two terminals (2×2 matrix).

This representation is obtained below. With these 8 terminals taken as a, b, c, d, e, f, g, and h, it is considered to correspond to a differential signal when c and d are open at the left end and e and f are open at the right end. Under these conditions, the following equation is satisfied.

Equation 4.

$$Jc=Jd=Je=Jf=0 \quad Ja=-Jb \quad Jc=-Jd \quad Je=-Jf \quad Jg=-Jh \tag{1}$$

$$Va=-Vb \quad Vc=-Vd \quad Ve=-Vf \quad Vg=-Vh \tag{2}$$

If kzZ=θ is set

Equation 5.

$$Ja/(jvp)=(Ca+Cab+Cac+Cad)(Vecsc(\theta)-Va\cot(\theta))-Cab(Vfcsc(\theta)-Vb\cot(\theta))$$

$$-Cac(Vgcsc(\theta)-Vccot(\theta))-Cad(Vhcsc(\theta)-Vd\cot(\theta)) \tag{3}$$

$$-Jb/(jvp)Jb=-Cab(Vecsc(\theta)-Va\cot(\theta))+(Ca+Cab+Cad+Cac)(Vfcsc(\theta)-Vb\cot(\theta))$$

$$-Cad(Vgcsc(\theta)-Vccot(\theta))-Cac(Vhcsc(\theta)-Vd\cot(\theta)) \tag{4}$$

$$0=-Cac(Vecsc(\theta)-Va\cot(\theta))-Cad(Vfcsc(\theta)-Vb\cot(\theta))$$

$$+(Cc+Cac+Cad+Ccd)(Vgcsc(\theta)-Vccot(\theta))-Ccd(Vhcsc(\theta)-Vd\cot(\theta)) \tag{5}$$

$$0=-Cad(Vecsc(\theta)-Va)-Cac(Vfcsc(\theta)-Vb\cot(\theta))-Ccd(Vgcsc(\theta)-Vccot(\theta))$$

$$+(Cc+Cad+Cac+Ccd)(Vhcsc(\theta)-Vd\cot(\theta)) \tag{6}$$

$$0=(Ca+Cab+Cac+Cad)(Vacsc(\theta)-Ve\cot(\theta))-Cab(Vbcsc(\theta)-Vf\cot(\theta))$$

$$-Cac(Vccsc(\theta)-Vg\cot(\theta))-Cad(Vdcsc(\theta)-Vh\cot(\theta)) \tag{7}$$

$$0=-Cab(Vacsc(\theta)-Ve\cot(\theta))+(Ca+Cab+Cad+Cac)(Vbcsc(\theta)-Vf\cot(\theta))$$

$$-Cad(Vccsc(\theta)-Vg\cot(\theta))-Cac(Vdcsc(\theta)-Vh\cot(\theta)) \tag{8}$$

$$Jg/(jvp)=-Cac(Vacsc(\theta)-Ve\cot(\theta))-Cad(Vbcsc(\theta)-Vf\cot(\theta))$$

$$+(Cc+Cac+Cad+Ccd)(Vccsc(\theta)-Vg\cot(\theta))-Ccd(Vdcsc(\theta)-Vh\cot(\theta)) \tag{9}$$

$$Jh/(jvp)=-Cad(Vacsc(\theta)-Ve\cot(\theta))-Cac(Vbcsc(\theta)-Vf\cot(\theta))$$

$$-Ccd(Vccsc(\theta)-Vg\cot(\theta))+(Cc+Cad+Cac+Ccd)(Vdcsc(\theta)-Vh\cot(\theta)) \tag{10}$$

Here, if expressions (2) is considered, all the reverence numerals of expression (3) and expression (4) are merely reversed and it is possible to use only expression (3). Similarly, expressions (6), (8) and (10) are the same as expressions (5), (7), and (9), and are not required. Substituting expression (2) after taking out only the required expressions, the following is obtained.

Equation 6.

$$Ja/(jvp)=(Ca+2Cab+Cac+Cad)(Vecsc(\theta)-Va\cot(\theta))+(Cad-Cac)(Vgcsc(\theta)-Vccot(\theta)) \quad (11)$$

$$0=(Cad-Cac)(Vecsc(\theta)-Va\cot(\theta))+(Cc+Cac+Cad+2Ccd)(Vgcsc(\theta)-Vccot(\theta)) \quad (12)$$

$$0=(Ca+2Cab+Cac+Cad)(Vacsc(\theta)-Ve\cot(\theta))+(Cad-Cac)(Vccsc(\theta)-Vg\cot(\theta)) \quad (13)$$

$$Jg/(jvp)=(Cad-Cac)(Vacsc(\theta)-Ve\cot(\theta))+(Cc+Cac+Cad+2Ccd)(Vccsc(\theta)-Vg\cot(\theta)) \quad (14)$$

From these expressions, it is possible to obtain functions for Va, Ja, Vg, and Ig, and so Vc and Ve can be eliminated.

Calculation results are as follows, and a voltage current equation for input/output of the differential signal is obtained as shown below.

Equation 7.

$$(Cac-Cad)Jgcsc(\theta)+(Cac+Cad+Cc+2Ccd)Ja\cot(\theta)=A(Csc^2(\theta)-\cot^2(\theta))Va=AVa$$

$$(Cac-Cad)Jacsc(\theta)+(Cac+Cad+Ca+2Cab)Jg\cot(\theta)=A(Csc^2(\theta)-\cot^2(\theta))Vg=AVg$$

Here, $A=jvp\{(Ca+Cac+Cad+2Cab)(Cc+Cac+Cad+2Ccd)-(Cac-Cad)^2\}$

If this is expressed as a Z matrix, the following is obtained.

Equation 8.

$$Z11=(Cac+Cad+Cc+2Ccd)\cot(\theta)/A$$

$$Z12=(Cac-Cad)csc(\theta)/A$$

$$Z22=(Cac+Cad+Ca+2Cab)\cot(\theta)/A$$

$$Z21=(Cac-Cad)csc(\theta)/A$$

Using this Z matrix, an S matrix for the case of input termination Zin and output termination Zout is obtained.

Equation 9.

$$B=\{(Z11/Zin+1)(Z22/Zout+1)-Z12Z21/(ZinZout)\},$$ then $$S11=\{(Z11/Zin-1)(Z22/Zout+1)-Z12Z21/ZinZout\}/B$$

$$S12=2*Z12/(ZinZout)$$

$$S21=2*Z21/(ZinZout)$$

$$S22=\{(Z11/Zin+1)(Z22/Zout-1)-Z12Z21/ZinZout\}$$

are obtained.

If the S matrix is expressed as C matrix elements, the following is obtained.

Equation 10.

$$S11=\{((Cac+Cad+Cc+2Ccd)\cot(\theta)-AZin)((Cac+Cad+Ca+2Cab)\cot(\theta)+AZout)-(Cac-Cad)^2csc^2(\theta)\}/\{((Cac+Cad+Cc+2Ccd)\cot(\theta)+AZin)((Cac+Cad+Ca+2Cab)\cot(\theta)+AZout)-(Cac-Cad)^2csc^2(\theta)\}$$

$$S22=\{((Cac+Cad+Cc+2Ccd)\cot(\theta)+AZin)((Cac+Cad+Ca+2Cab)\cot(\theta)-AZout)-(Cac-Cad)^2csc^2(\theta)\}/\{((Cac+Cad+Cc+2Ccd)\cot(\theta)+AZin)((Cac+Cad+Ca+2Cab)\cot(\theta)+AZout)-(Cac-Cad)^2csc^2(\theta)\}$$

$$S21=S12=A\sqrt{(ZinZout)}\{2*(Cac-Cad)csc(\theta)\}/\{((Cac+Cad+Cc+2Ccd)\cot(\theta)+AZin)((Cac+Cad+Ca+2Cab)\cot(\theta)+AZout)-(Cac-Cad)^2csc^2(\theta)\}$$

When the line length is a quarter wavelength, $\theta=\pi/2$, $csc(\theta)=1$, $\cot(\theta)=0$, and A is a purely imaginary number, which means that Equation 11.

$$A^2=-|A|^2$$

$$S11=\{|A|^2ZinZout-(Cac-Cad)^2\}/\{-|A|^2ZinZout-(Cac-Cad)^2\}$$

$$S22=\{|A|^2ZinZout-(Cac-Cad)^2\}/\{-|A|^2ZinZout-(Cac-Cad)^2\}$$

$$S21=S12=2A\sqrt{(ZinZout)}(Cac-Cad)/\{-|A|^2ZinZout-(Cac-Cad)^2\}$$

and accordingly, by making

Equation 12.

$$|A|^2ZinZout-(Cac-Cad)^2=0$$

then S11=S22=0.

At this time, Cac−Cad is equal to the product of the absolute value of A and the square root of (ZinZout). With the previous structure, Cac is an electrode facing vertically, and Cad is an electrode that faces in an inclined manner, and so since Cac>Cad, a negative value cannot be a solution.

Equation 13.

$$S21=2j|A|\sqrt{ZinZout}|A|\sqrt{ZinZout}/\{-2|A|^2ZinZout\}=-j$$

This will give 100% passing.

On the other hand, when the line length is 0 or a half wavelength, $csc(\theta)$=infinity, $\cot(\theta)$=infinity, and double the absolute value of $(csc(\theta)/\cot(\theta))$ converges to 1.

Accordingly, as a result of

Equation 14.

$$\begin{aligned}
S11 - \{&((Cac + Cad + Ce + 2Ccd)cot(\theta) - \\
&AZin)((Cac + Cad + Ca + 2Cab)cot(\theta) + \\
&AZout) - (Cac - Cad)^2\csc^2(\theta)\}/ \\
&\{((Cac + Cad + Cc + 2Ccd)cot(\theta) + \\
&AZin)((Cac + Cad + Ca + 2Cab)cot(\theta) + \\
&AZout) - (Cac - Cad)^2\csc^2(\theta)\} \rightarrow \\
&\{(Cac + Cad + Cc + 2Ccd)cot(\theta)((Cac + Cad + Ca + \\
&2Cab)cot(\theta)) - (Cac - Cad)^2\csc^2(\theta)\}/ \\
&\{(Cac + Cad + Cc + 2Ccd)cot(\theta)(Cac + Cad + Ca + \\
&2Cab)cot(\theta) - (Cac - Cad)^2\csc^2(\theta)\} \rightarrow \\
&\{(Cac + Cad + Cc + 2Ccd)((Cac + Cad + Ca + \\
&2Cab)) - (Cac - Cad)^2\}/ \\
&\{(Cac + Cad + Cc + 2Ccd)(Cac + Cad + \\
&Ca + 2Cab) - (Cac - Cad)^2\}
\end{aligned}$$

there is complete reflection and passing is 0.

Figure 4:
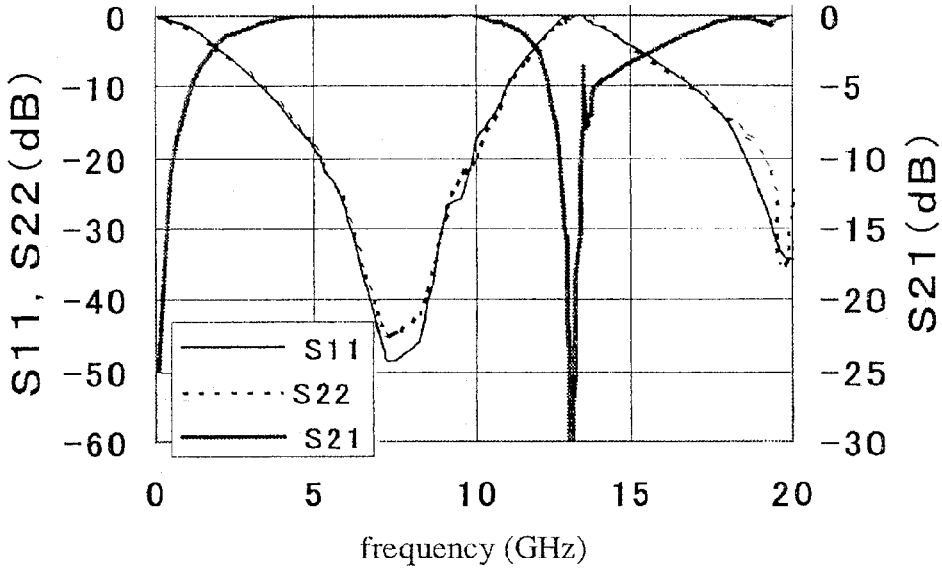
FIG. 4 shows characteristics of the filter relating to the first embodiment of the invention.
Figure 4:
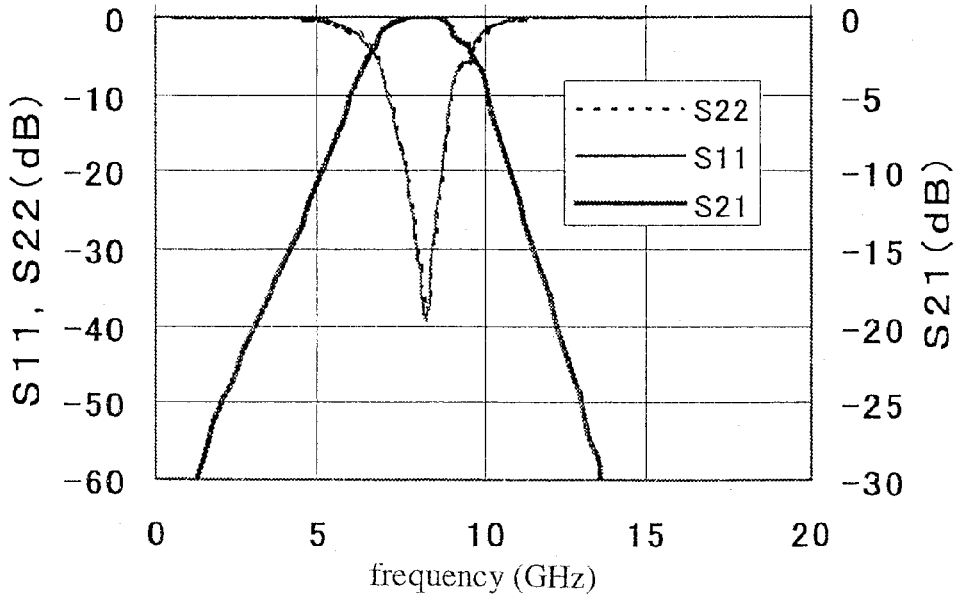

If frequency is taken into consideration, the characteristic of the bandpass filter becomes such that it passes at a frequency f0 giving a quarter wavelength, and stops at DC or a frequency of 2f0. An example of frequency characteristic when actual values are entered is shown in FIG. 4.

Equation 15.

$$|A|^2 ZinZout-(Cac-Cad)^2=0$$

This is the state when S11=S22=0, but this means that it is possible to match an arbitrary input/output impedance if capacitance between lines is controlled, indicating that it is possible to use in impedance conversion of a differential signal. Accordingly, the 4 connected lines of the first embodiment of the invention provide two functions, namely a bandpass filter function and an impedance conversion function.

With electromagnetic field simulation for confirming the above-described effectiveness, effects confirming the characteristics of the bandpass filter are shown in FIG. 4. Example characteristics of a bandpass filter for a differential signal relating to the first embodiment of the invention are shown in FIG. 4. FIG. 4(*a*) shows example characteristics for a wideband pass filter, and FIG. 4(*b*) shows example characteristics for a narrowband pass filter.

FIG. 4(*a*) is an example where the lines are arranged on both sides of the dielectric body 9, as shown in FIG. 2(*c*), with above the lines 1 and 2 and below the lines 3 and 4 forming a space of dielectric constant 1. The dielectric body 9 has a thickness of 0.1 mm, and a dielectric constant of 10.2. The dimensions of the four lines are all the same, being 0.4 mm×3.8 mm, with a line distance of 0.1 mm. The first line 1 and the third line 3, and the second line 2 and the fourth line 4, respectively overlap vertically. The load impedance is 64.6 ohms at both input and output. According to FIG. 4(*a*), it is possible to realize an ultrawideband filter having a pass band of about 3-11 GHz.

FIG. 4(*b*) is also an example where the lines are arranged on both sides of the dielectric body 9, as shown in FIG. 2(*c*), with above the lines 1 and 2 and below the lines 3 and 4 forming a space of dielectric constant 1. The dielectric body 9 has a thickness of 0.4 mm, and a dielectric constant of 3.6. The dimensions of the four lines are all the same, being 0.4 mm×5.85 mm, with a line distance of 0.1 mm. The first line 1 and the third line 3, and the second line 2 and the fourth line 4, respectively overlap vertically. The load impedance is 34.1 ohms at both input and output. According to FIG. 4(*b*), it is possible to realize a comparatively narrow band filter having a pass band of 1 GHz in width at about 7.5-8.5 GHz. The stop characteristics are not so good, but this point can be simply improved by cascade connection.

Second Embodiment of the Invention

UWB communication systems suppress interference with other wireless systems by having small transmission power. However, 5 GHz band wireless LAN systems used between individuals similarly are often in the same room, and in this case, it is confirmed that interference arises. In order to avoid this, a 5-6 GHz band used in a wireless LAN was evaluated so that there was no radio wave output in the UWB. The second embodiment of the invention is used in an intermediate manner in this way, and a band stop filter for steeply cutting off some frequencies within a band of a wideband pass filter of the first embodiment of the invention, and minimizing effects on other bands, is provided in the wideband pass filter of the first embodiment.

Figure 5:
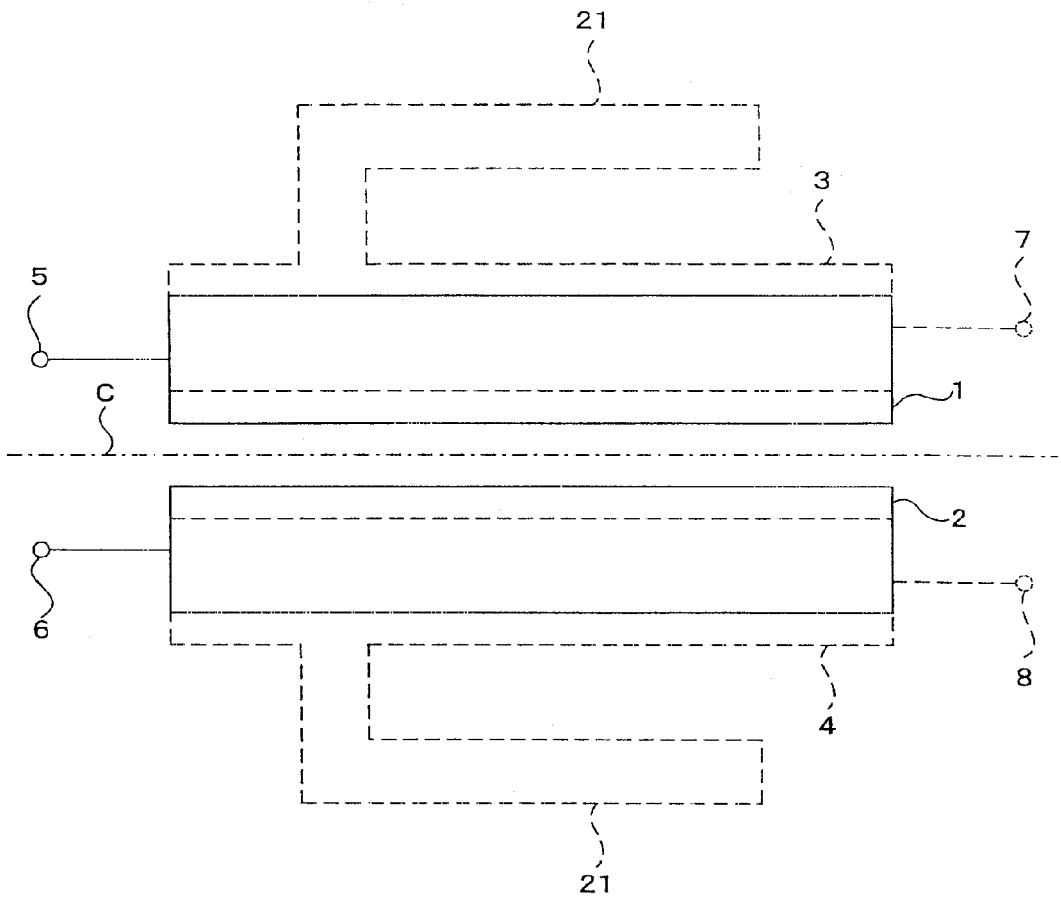
FIG. 5 is a plan view of the filter relating to the second embodiment of the invention.

FIG. 5 is a plan view of a wideband filter for a differential signal fitted with a band stop filter of the second embodiment of the invention. In FIG. 5, the same reference numerals are attached to sections that are the same as in FIG. 1. As will be easily understood from comparison with FIG. 5, the filter of FIG. 5 has a band stop filter 21 added to the third line 3 and fourth line 4 of the filter of FIG. 1.

The bandstop filter 21 is a pair of lines having a length that is a quarter wavelength (Specifically, 0.25 wavelengths, 0.75 wavelengths, 1.25 wavelengths, 1.75 wavelengths, etc.) of the frequency it is desired to stop, with another end open. The band stop filter 21 is provided in parallel to one end of the third line 3 and the fourth line 4. In FIG. 5, the line 21 is connected to the third line 3 and the fourth line 4, but it is also possible to connect to the first line 1 and the second line 2. With the filter of FIG. 5 also, a differential signal is input to one input/output terminal 5, 6 (or 7, 8), and a differential signal is extracted from the other input/output terminal 7, 8 (or 5, 6).

Operation of the bandpass filter for a differential signal relating to the second embodiment of the invention will now be described with reference to FIG. 5. The first and second lines 1 and 2, and the third and fourth line 3 and 4 constitute the 4 line bandpass filter of the first embodiment of the invention. When a differential signal of a frequency it is desired to stop is input from 5, 6, since a short impedance is added in parallel to the third line 3 and fourth line 4 connected to the band stop filter 21, due to the quarter wavelength length of the other end that is open, the impedance at the connection point to the band stop filter 21 becomes a short, and at this point the signal is completely reflected, and so that frequency can no longer be passed. FIG. 5 becomes a band stop filter.

According to the wideband filter for a differential signal fitted with a band stop filter of the second embodiment of the invention, in addition to the bandpass filter function, it is possible to selectively cause large attenuation of a frequency it is desired to stop.

The Third Embodiment of the Invention

A filter of the third embodiment of the invention has two wideband bandpass filters of the first embodiment of the invention cascade-connected, and is provided with a band stop filter for cutting off some frequencies within that band steeply while keeping the effect on other bands to a minimum connected to the cascade connection point. The filter of the third embodiment of the invention has a different structure to embodiments 1 and 2 of the invention.

Figure 6:
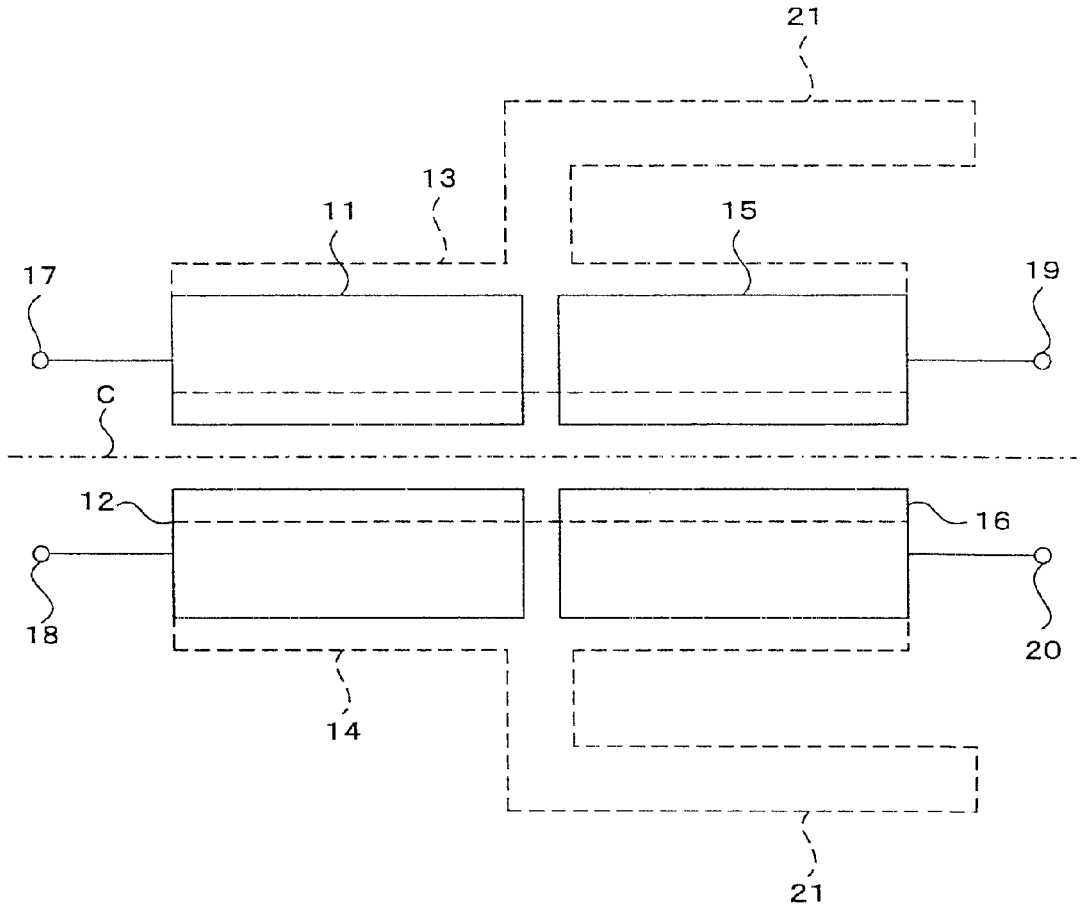
FIG. 6 is a plan view of the filter relating to the third embodiment of the invention.

FIG. 6 is a plan view of the filter relating to the third embodiment of the invention. Reference numerals 11 and 12 are a first line and a second line arranged on a first surface. The first line 11 and second line 12 have respective line lengths equivalent to about a quarter wavelength of a center frequency of a used band (0.25 wavelengths, 0.75 wavelengths, 1.25 wavelengths, 1.75 wavelengths etc.) but are actually slightly shorter than a quarter wavelength (for example, 1/100 of wavelength (0.01) shorter). Reference numerals 13 and 14 are a third line and a fourth line arranged on a second surface. The third line 13 and the fourth 14 respectively have line lengths equivalent to about a half wavelength of a center frequency of a used band (0.5 wavelengths, 1.5 wavelengths, 2.5 wavelengths, 3.5 wavelengths, etc.). Quarter wavelength lines 21, 21 are respectively connected to substantially the center of the third line 13 and the fourth line 14.

Reference numerals 15 and 16 are a fifth line and a sixth line arranged on the first surface. The fifth line 15 and the sixth line 16 have respective line lengths equivalent to about a quarter wavelength of a center frequency of a used band (0.25 wavelengths, 0.75 wavelengths, 1.25 wavelengths, 1.75 wavelengths, etc.) but are actually slightly shorter than a quarter wavelength (for example, 1/100 of wavelength (0.01) shorter). The fifth line 15 and the sixth line 16 are separated from the first line 11 and the second line 12. Reference numeral 17 is a differential input/output terminal of the first line 11, 18 is a differential input/output terminal of the second line 12, 19 is a differential input/output terminal of the fifth line 15, and 20 is a differential input/output terminal of the sixth line 16. The terminals 17 and 18 constitute a paired differential input/output terminal, and the terminals 19 and 20 constitute a paired differential input/output terminal.

Reference numeral 21 is a pair of lines having a length of a quarter wavelength of a frequency within the band it is desired to stop, connected to substantially the center of the third line 13 and the fourth line 14. Ends of the lines 21 at the opposite side to a connection point between the line 21 and the lines 13 and 14 are open. The lines 21 functions as a band stop filter.

With the filter of FIG. 6 also, a differential signal is input to one input/output terminal 17, 18 (or 19, 20), and a differential signal is extracted from the other input/output terminal 19, 20 (or 17, 18).

With the third embodiment of the invention, bandpass filters having the structure of the first embodiment are connected in a two-stage cascade structure, as shown in FIG. 6, with a pair of lines 21, 21 having a length of a quarter wavelength at the frequency it is desired to stop and another end open respectively connected in parallel to connection points of two lines (gap between lines 11 and 15, and gap between lines 12 and 16). If the lines 11 and 15, and the lines 12 and 16, are simply connected, a terminal that is open will also be connected. In order to keep that terminal open, the lines 11 and 15 (or the lines 12 and 16) can be made slightly shorter than a quarter wavelength (for example, about 1/00th (0.01) of a wavelength shorter). Alternatively, it is possible to make the lines 13 and 14 slightly longer.

Operation of the filter relating to the third embodiment of the invention will be described using FIG. 6.

The left half section of the first and second lines 11 and 12, and the third and fourth line 13 and 14 constitute the 4 line bandpass filter of the first embodiment of the invention. Similarly, the right half section of the fifth and sixth lines 15 and 16, and the third and fourth lines 13 and 14 constitute the 4 line bandpass filter of the first embodiment of the invention. Accordingly, the filter of FIG. 6 is a cascade connection of one more four line bandpass filter constituted by the right half of the fifth and sixth lines 15, 16 and the third and fourth lines 13, 14 to the four line bandpass filter constituted by the left half of the first and second lines 11, 12 and the third and fourth lines 13, 14.

Since the third line 13 and fourth line 14 have both ends open, the impedance of these connection sections (center sections) is a low impedance close to a short in the center of the band. A band stop filter 21, namely the quarter wavelength line 21 at the desired stop frequency, is connected to this part. The line 21 is open at an opposite side to that connection end, and so at the frequency that is desired to be stopped it is a low impedance close to a short. On the other hand, the third line 13 and the fourth line 14 have a half wavelength at the center frequency of the bandpass filter and are not entirely a short at the desired stop frequency, but since both ends are open they become low impedance.

When a differential signal at the frequency that is desired to be stopped is input from the input/output terminals 17, 18, a differential signal is output to the terminals of the third line 13 and the fourth line 14 (connection point, center section), as described for the first embodiment of the invention, but because of the line 21, a short impedance is added in parallel at that point, which means that the impedance of that point becomes a short, the signal is completely reflected and that frequency cannot pass. The line 21 functions as a band stop filter. The stop frequency bandwidth at this time becomes steeper as the Q value is increased, but the impedance looking at the bandpass filter is also a low impedance at the center of both open ends, which means that a load Q, including a load, does not decrease very much. Therefore, a steep bandpass filter is constructed.

Figure 7:
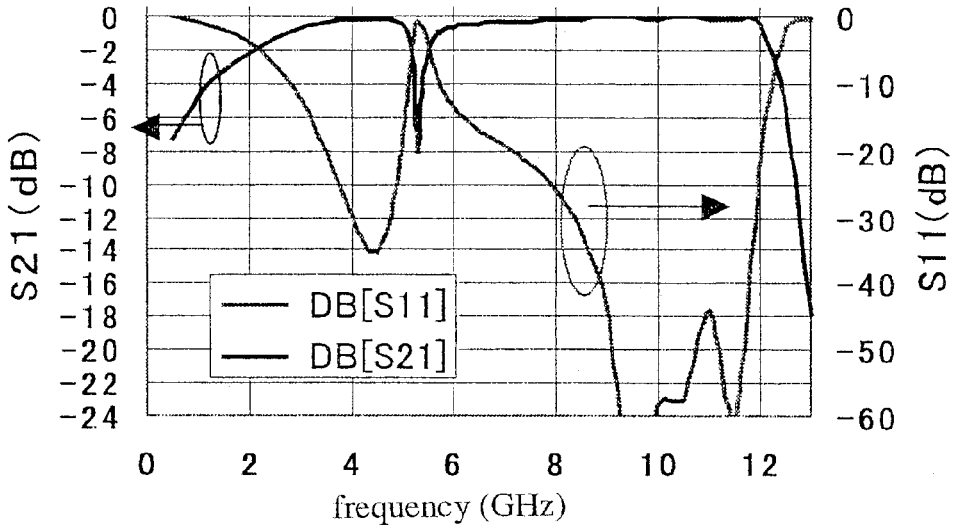
FIG. 7 shows characteristics of the filter relating to the third embodiment of the invention.

FIG. 7 shows simulation results for the filter relating to the third embodiment of the invention. The dielectric body has a thickness of 0.1 mm, and a dielectric constant of 10.2. Each line has a length of 3.8 mm and a width of 0.4 mm, with two lines being provided on both surfaces of the dielectric body, as shown in FIG. 2(*c*). Each line is arranged overlapping at the same position of the two surfaces. Within the pass band of 3-12 GHz, a 1 GHz band from 5-6 GHz is stopped.

According to the third embodiment of the invention, it is possible to stop only some frequencies within the band of the bandpass filter without having much effect on other frequencies. In particular, since the band stop filter is connected to a low impedance point, namely a connection point when connecting two bandpass filters in a cascade configuration, it is possible to make the Q value large. When unnecessary frequencies outside the band are removed, it goes without saying that the effect on unnecessary frequencies within the band is further decreased.

Fourth Embodiment of the Invention

The bandpass filter using distributed constant lines of embodiments 1-3 of the invention has characteristics that repeat at fixed frequency intervals. For this reason, in the event that there is an upper limit frequency (with UWB 10.6 GHz) close to twice the center frequency (for example, 6.85 GHz), the next pass band will be very close, the frequency range cut off will be reduced, and the effect of noise due to the next pass band cannot be ignored. The filter relating to the fourth embodiment of the invention solves this type of problem. By adding the low pass filter to the bandpass filter of embodiments 1-3 of the invention, a second pass band is cut and it possible to suppress noise caused by this frequency band. The bandpass filter of embodiments 1-3 of the present invention handles a differential signal, and the phases of the two lines are required to be always 180° apart. With the fourth embodiment of the invention, by arranging a low pass filter in both lines, the phase is caused to change equally, and the phase difference between the two lines is held at 180°.

Figure 8:
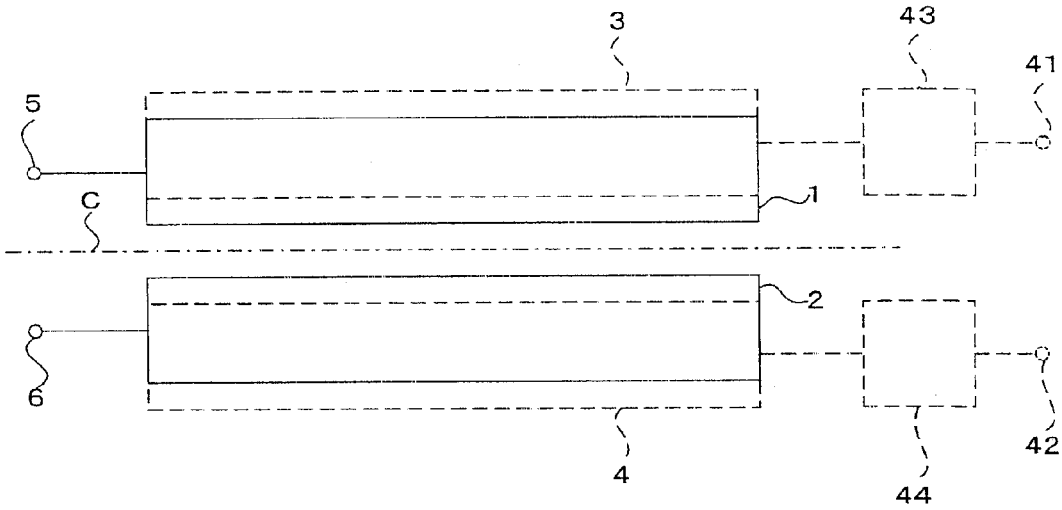
FIG. 8 is a schematic drawing of the filter relating to the fourth embodiment of the invention.

FIG. 8 is a plan view of a wideband filter, having a low pass filter, of the fourth embodiment of the invention. In FIG. 8, the same reference numerals are attached to sections that are the same as in FIG. 1. In addition to the first line 1 to fourth line 4 and input output terminals 5, 6 of FIG. 1, the filter of FIG. 8 is provided with low pass filters 43 and 44 having identical characteristics. The input/output end of the third line 3 is connected to the low pass filter 43, while the input/output end of the fourth line 4 is connected to the low pass filter 44. Reference numeral 41 is an end connected to another end of the low pass filter 43, and this constitutes a terminal for taking out a signal of the third line 3. Reference numeral 42 is an end connected to the other end of the low pass filter 44 and constitutes an end for taking out a signal of the fourth line 4. A differential signal is applied across the terminals 41 and 42.

If a differential signal is input from the terminals 5, 6 on the left side of the filter of FIG. 8, a 180° phase difference of the differential signal is maintained at the bandpass filter. Also, with the low pass filters 43 and 44, the phase slips at each line due to the low pass filters 43 and 44, but this phase difference is uniform, and so a 180° phase difference is maintained, and a differential signal is output from the terminals 41 and 42.

A pass band of the bandpass filter relating to the first embodiment of the invention appears repeatedly, as shown in FIG. 4(*a*). If the center frequency of a first pass band is made f0, the minimum pass frequency of the first pass band is made f1 and the maximum frequency of the first pass band is made f2, then in a period of 2f0 passing and stopping is repeated. As the low pass filters 43 and 44 of FIG. 8, filters are used that stop frequencies lower than 2f0+f1 and higher than f2, so that it is possible to stop the second pass band of the bandpass filter.

According to the fourth embodiment of the invention, only a first pass band is selected for the pass band. In particular, when the bandpass filter has a wide band, the second pass band is very close to the first pass band, and so by removing the second pass band the effect of removing the noise of an unnecessary band is significant. Because the low pass filter is respectively provided with the third line 3 (or first line 1) and the fourth line 4 (or second line 2), it is possible to maintain a phase difference between the lines at 180° and a differential signal is output.

With FIG. 8, respective low pass filters 44, 44 are provided on the third line 3 and the fourth line 4, but these can also be provided on the input/output ends of the first line 1 and the second line 2. Also, when low pass filters are provided in the filter of the third embodiment of the invention, the filters can be respectively provided at the input/output ends of the fifth line 5 and the sixth line 6. These are effectively the same.

Fifth Embodiment of the Invention

Description has been given above for a UWB system, it goes without saying that the present invention can also be applied to other communication systems. For example, it is convenient if two frequencies of a 2.5 GHz band and a 5.2 GHz band used in a wireless LAN system can be used with a single antenna. If a wideband antenna is used, an antenna that can be used for both frequencies is made possible. The used frequency band is allowed to pass, while a frequency band that is not used is stopped, giving an antenna that suppresses noise of that band, which is extremely beneficial. This can be realized using the filter of embodiments 1 to 4 of the invention. A multifrequency antenna related to the fifth embodiment of the present invention brings about such convenience, and a filter serves as a feed line for the antenna, and is also small an inexpensive.

Figure 9:
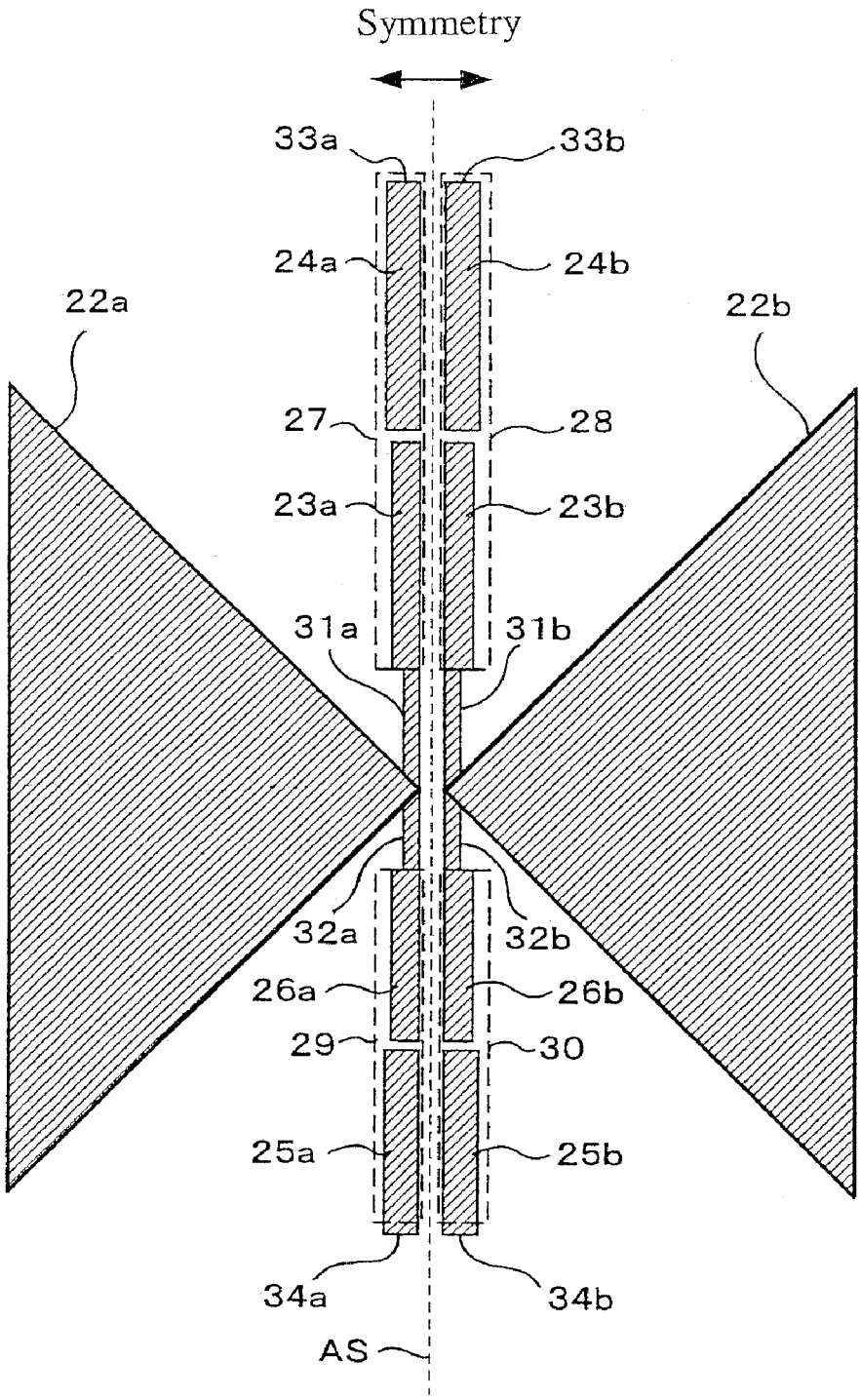
FIG. 9 is a plan view of a two-frequency antenna relating to the fifth embodiment of the invention.

FIG. 9 is a plan view of a two-frequency antenna relating to the fifth embodiment of the invention.

Reference numeral 22 is a pattern for a wide band antenna.

Lines 23*a*, 23*b*, 24*a*, 24*b*, 27, and 28 are a two-stage bandpass filter of the third embodiment of the invention (first bandpass filter). Reference numerals 33*a* and 33*b* are input/output ends thereof. Reference numerals 33*a* and 33*b* constitute a differential signal feed terminal. The other ends are connected to lines 31*a* and 31*b*. Reference numerals 23*a*, 23*b*, 24*a*, 24*b*, 27, 28, 33*a*, and 33*b* in FIG. 9 respectively correspond to numerals 11, 12, 15, 16, 13, 14, 19, and 20 in FIG. 6.

Similarly, lines 25*a*, 25*b*, 26*a*, 26*b*, 29, and 30 are a two-stage bandpass filter (second bandpass filter). Reference numerals 34*a* and 34*b* are input/output ends thereof. Reference numerals 34*a* and 34*b* constitute a differential signal feed terminal. The other ends are connected to lines 32*a* and 32*b*. Reference numerals 25*a*, 25*b*, 26*a*, 26*b*, 29, 30, 34*a*, and 34*b* in FIG. 9 respectively correspond to numerals 11, 12, 15, 16, 13, 14, 17, and 18 in FIG. 6.

The first pass filter and the second pass filter are respectively different sizes, causing the pass bands to be different. The filter of FIG. 9 is not provided with the band stop filter of FIG. 6.

Numerals 31*a* and 31*b* are 2 parallel lines for allowing the first bandpass filter to rotate phase of a signal so that there is a high impedance in a pass band of the second bandpass filter, and 32*a* and 32*b* are lines for conversely allowing the second bandpass filter to rotate phase of a signal so that there is high impedance in the pass band of the first bandpass filter.

The device of FIG. 9 has a first bandpass filter and a second bandpass filter connected in parallel to a single antenna 22*a*, 22*b*.

Next, operation will be described. Consider that the bands of the wideband antennas 22*a* and 22*b* can be made extremely wide, for example 2-11 GHz, and a case will be considered where the bands of the first bandpass filter and the second bandpass filter are, as two frequencies of 2.4 to 2.5 GHz and 5.15 to 5.35 GHz used for a wireless LAN, smaller than the band of the wideband antenna 22*a* and 22*d*. Making the bandpass filter of the third embodiment of the invention compatible with these two frequencies can be achieved simply by appropriately selecting the length of each line. However, there is a problem that if the first filter and the second filter have an effect on the impedance of each other in their respective bands, the characteristics of each antenna will be degraded.

The bands of the first bandpass filter and a second bandpass filter do not overlap, which means that a reflection coefficient to the other band will be large. Phase of a signal is then caused to rotate so that there is high impedance in the pass band of the second bandpass filter using the lines 31*a* and 31*b*. By doing this, the first bandpass filter is put in an open state, and it is possible to prevent influence within the other band. Similarly, phase of a signal is rotated so that there is high impedance in the pass band of the first bandpass filter using the lines 32*a* and 32*b*.

As described with the third embodiment of the invention, if a signal is input from the input/output terminals 33*a*, 33*b* of the first bandpass filter, only frequencies passed by the first bandpass filter are transmitted to the antennas 22*a* and 22*b*. Conversely, within signals received by the antennas 22*a*, 22*b*, only frequencies passed by the first bandpass filter appear at the input/output terminals 33*a*, 33*b*. This is also the same for the second bandpass filter.

There are various structures for the wide band antenna, but there is, for example, an antenna having a self-complementary structure. 22*a* and 22*b* in FIG. 9 representing antennas having a self complementary structure. The antennas 22*a*, 22*b* are left-right-symmetrical about the axis of symmetry AS, and if they are rotated about a point of symmetry between the antennas 22*a* and 22*b* by 180°, antenna conductors overlap with themselves, while if they are rotated 90°, it gives a self complementary structure where sections with no pattern overlap except for a portion at a central distance. Since distance exists between the antennas 22 and 22*b*, it cannot be said that the antenna of FIG. 9 has a completely self complementary structure, but the same operational effects are achieved as with an actual self complementary antenna. A distance is provided between the antennas 22*a* and 22*b*. This distance is 1/10th or less (preferably 1/30th or less) the wavelength of a usage frequency in a vacuum.

According to the fifth embodiment of the invention, it is possible to provide a two-frequency antenna that can selectively transmit and receive two frequencies. Moreover, since a first bandpass filter and a second bandpass filter for realizing a frequency selecting function also serve as feed lines, a small antenna is made possible, and it is possible to have a structure that is inexpensive. Here, with the two-frequency example, there are two pairs of feed lines, but by providing a plurality of feed lines it is possible to easily construct a multifrequency antenna for three or more frequencies.

The present invention is not limited to the above-described embodiment, and various modifications are possible within the scope of the attached patent claims. These are also included within the spirit and scope of the present invention. For example, the above description has centered on a UWB system, but it goes without saying that the present invention can also be applied to other communication systems.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A bandpass filter for a differential signal, comprising a dielectric body, a first line and a second line on a surface of the dielectric body or a first surface of an inner part of the dielectric body arranged symmetrically to each other with respect to a surface of symmetry crossing the first surface, a third line and a fourth line on another surface of the dielectric body or a second surface which is another surface of an inner part of the dielectric body and faces the first surface, arranged symmetrically to each other with respect to the surface of symmetry, and a fifth line and a sixth line arranged symmetrically to each other with respect to the surface of symmetry on the first surface, wherein, the first line, the second line, the fifth line, and the sixth line respectively have a line length equivalent to a quarter wavelength of a center frequency of a used band;

the third line and the fourth respectively have line lengths equivalent to a half wavelength of a center frequency of a used band;

the first line, the second line, the fifth line, and the sixth line respectively have one end as an input/output end, and the other end as an open end;

both ends of each of the third line and the fourth line are open ends;

the first line and the fifth line are arranged in a cascade manner with their open ends adjacent, and both are facing the third line; and the second line and the sixth line are arranged in a cascade manner with their open ends adjacent, and both are facing the fourth line.

2. The bandpass filter for a differential signal as disclosed in claim 1, wherein a line having a line length equivalent to a quarter wavelength of a frequency to be stopped and with one end open is connected to the third line close to a connection point between open ends of the first line and the fifth line; and a line having a line length equivalent to a quarter wavelength of a frequency to be stopped and with one end open is connected to the fourth line close to a connection point between open ends of the second line and the sixth line.

3. The bandpass filter for a differential signal as disclosed in claim 1, wherein low-pass filters for stopping a signal that is a higher than a predetermined frequency are respectively provided at input/output ends of the first line and the second line.

4. A multifrequency antenna, comprising a wideband antenna driven by a differential signal, and a first bandpass filter and a second bandpass filter connected in parallel to a feed point of the wideband antenna, wherein the first bandpass filter and/or the second bandpass filter are the bandpass filter for a differential signal as disclosed in claim 1.

* * * * *